United States Patent [19]

Flierl et al.

[11] Patent Number: 4,894,638

[45] Date of Patent: Jan. 16, 1990

[54] POTENTIOMETER HAVING VIBRATION DAMPING MEANS

[75] Inventors: Werner Flierl, Höhenkirchen; Horst Pissulla, Ottobrunn, both of Fed. Rep. of Germany

[73] Assignee: Wilhelm Ruf Kg, Munich, Fed. Rep. of Germany

[21] Appl. No.: 187,775

[22] Filed: Apr. 29, 1988

[30] Foreign Application Priority Data

Apr. 29, 1987 [DE] Fed. Rep. of Germany ..... 3714348

[51] Int. Cl.[4] ..... H01C 10/32

[52] U.S. Cl. ..... 338/162; 338/184; 338/192

[58] Field of Search ..... 338/162, 124, 192, 167, 338/168, 170, 184, 185, 199, 277, 333, 334, 315, 316

[56] References Cited

U.S. PATENT DOCUMENTS

| | | | |
|---|---|---|---|
| 2,836,690 | 5/1958 | Barr | 338/124 |
| 3,138,777 | 6/1964 | Wormser et al. | 338/183 |
| 4,053,865 | 11/1977 | Brown, Jr. | 338/180 |

*Primary Examiner*—B. A. Reynolds
*Assistant Examiner*—M. Lateef
*Attorney, Agent, or Firm*—Cushman, Darby & Cushman

[57] ABSTRACT

A potentiometer for attachment to objects undergoing strong vibrations, such as the engine block of an internal combustion engine has an outer housing which is secured to the object and an inner housing which is largely positioned inside the outer housing. The two housings are connected by at least one springy damping member, such as an O-ring made of rubber and, at the same time, they are largely uncoupled with respect to vibrations.

19 Claims, 5 Drawing Sheets

POTENTIOMETER HAVING VIBRATION DAMPING MEANS

BACKGROUND OF THE INVENTION

1. Field of the Art

The present invention relates to a potentiometer, and, more particularly, to a potentiometer used in a device that experiences mechanical vibrations.

2. Background of the Prior Art

Potentiometers are used, for example, as measuring transducers or sensors in control or regulation systems in which the position of a movable element is sampled and the potentiometer then furnishes an electrical output signal which is proportional to the position sensed. Such a potentiometer, for instance may be used to sample the position of a throttle valve in an internal combustion engine.

In those cases, the potentiometer is fastened to another object, such as being fastened directly at the engine block of an internal combustion engine. As a consequence, the potentiometer receives all movements, especially vibrations of the other object. It was found with diesel engines, for example, that a potentiometer directly flange-connected to the engine block is subjected to accelerations of up to 300g (g=acceleration due. to gravity). Due to the mass inertia of the components which are movable with respect to each other and the potentiometer, especially the mass inertia with respect to the slider, such accelerations cause the slider to oscillate with respect to the resistor path on the resistor plate, and that will result in the abrasion of the resistor layer. Tests made with conventional potentiometers which were flange-connected to a diesel engine have shown that the resistor layer was rubbed down in no more than 3 to 4 hours. The potentiometer then could no longer be used.

It has been attempted to solve the above described problem by providing damped support for the entire potentiometer with respect to the engine block, such as by bolting it to the engine block with rubber buffers in between. However, the desired longer service life was not achieved by that measure and also turned out to be rather costly. Also, adjustment of the potentiometer was expensive because any tightening of the fastening screws necessarily caused deformation of the rubber buffers, thereby changing the relative positions of the potentiometer and the engine block, and causing non-alignment requiring further adjustment. In other words, the electrical output signal of the potentiometer depends on the force by which the fastening bolts are tightened. The sealing of the engine block with respect to the potentiometer likewise causes difficulty.

SUMMARY OF THE INVENTION

It is, therefore, an object of the present invention to improve a potentiometer of the kind described initially such that its useful life will be prolonged when the potentiometer is fastened to mechanically vibrating objects, thereby being subjected to high accelerations.

This object is met, in accordance with the invention, by having a potentiometer with a housing divided into an outer housing and an inner housing which is largely disposed inside the outer housing. Both housings are connected by a springy damping member. The flange and the electrical terminals are retained at the outer housing and both the resistor plate and the actuator member at the inner housing.

It is the basic concept of the invention no longer to uncouple the entire potentiometer from the other object with respect to vibrations (e.g. from the entire block) but instead only certain component parts that are subject to wear. As the outer housing is connected rigidly to the other object, the respective position in space of the potentiometer and the other object is defined clearly so that any adjusting becomes almost superfluous and faulty installation is avoided.

A further object of the present invention is to further improve the damping by precisely aligning the inner and outer housings with respect to each other.

Another object of the present invention is to utilize silicone to obtain the best damping behavior.

BRIEF DESCRIPTION OF THE DRAWINGS

This invention will be described further, by way of example, with reference to the accompanying drawings, in which.

DESCRIPTION OF THE PREFERRED EMBODIMENT

The embodiment described is a so-called linear potentiometer, the actuator member of which (being operable from outside) is moved rectilinearly or following the course of a line. It will be obvious to those skilled in the art that the invention is applicable just as well to rotational or spindle-type potentiometers.

Figure 3:
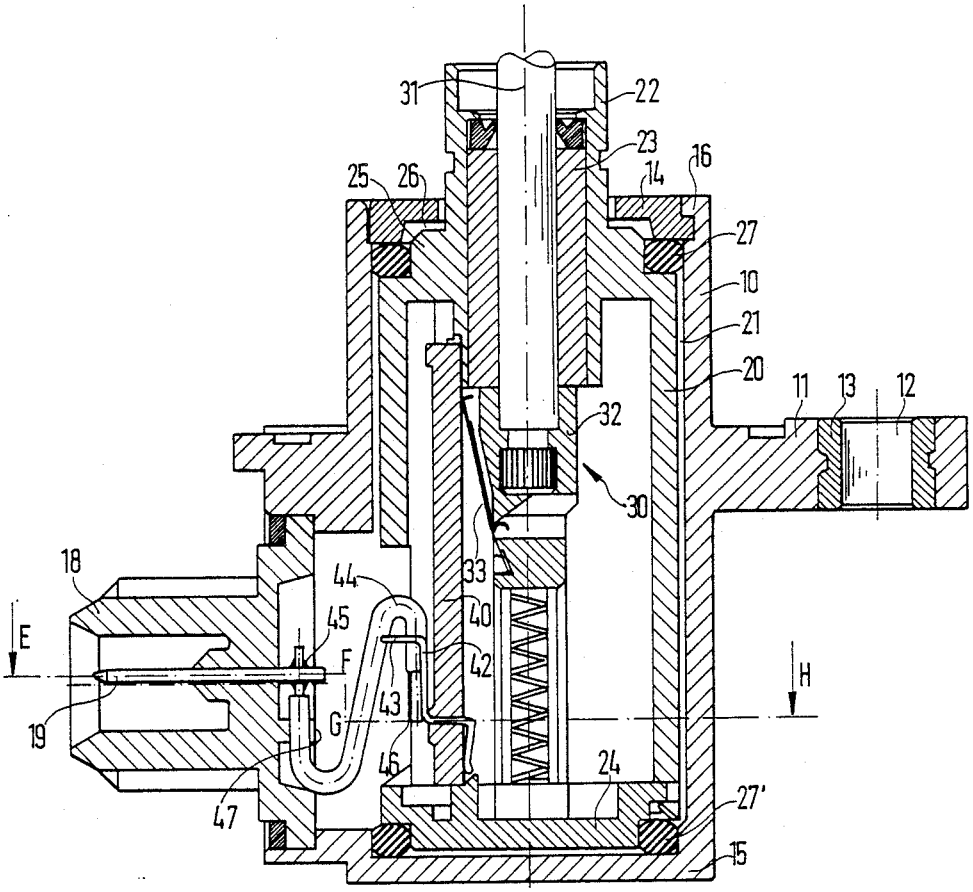
FIG. 3 is a longitudinal sectional view of the potentiometer, rotated through 90° with respect to the plane of the cut shown in FIG. 1 (sectioned along line A–B in FIG. 1)

As shown in FIG. 3, the potentiometer comprises an outer housing 10 which is substantially cylindrical and has a radial flange 11 projecting approximately from the middle thereof and having through bores 12 which extend in an axial direction and into which metal sleeves 13 are cast. These through bores 12 permit the outer housing 10 to be fastened by threaded bolts to another object.

Figure 1:
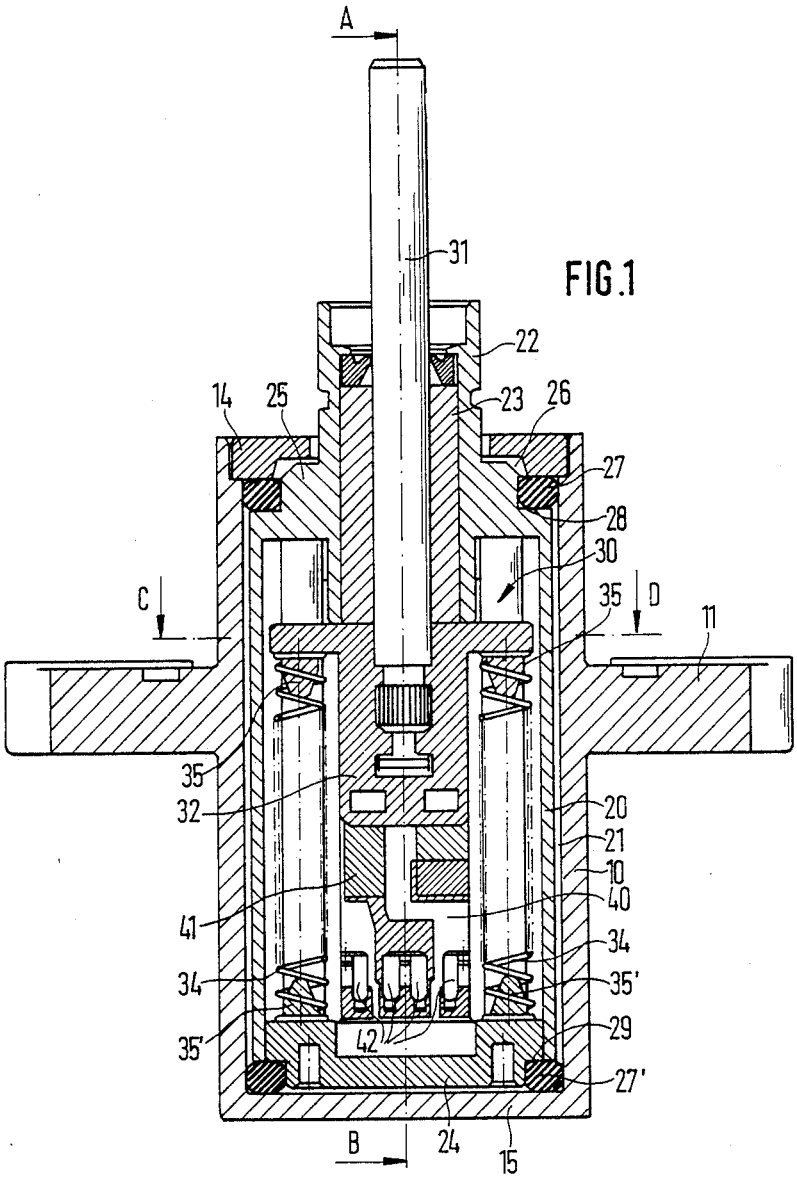
FIG. 1 is a longitudinal sectional view of a potentiometer according to the invention.

In axial direction, the outer housing 10 is open at one end into which a cap 14 is snapped behind a detent lug 16 for closing as shown in FIG. 1. At the closed end there is a bottom 15 which is connected integrally to the outer housing 10.

Figure 4:
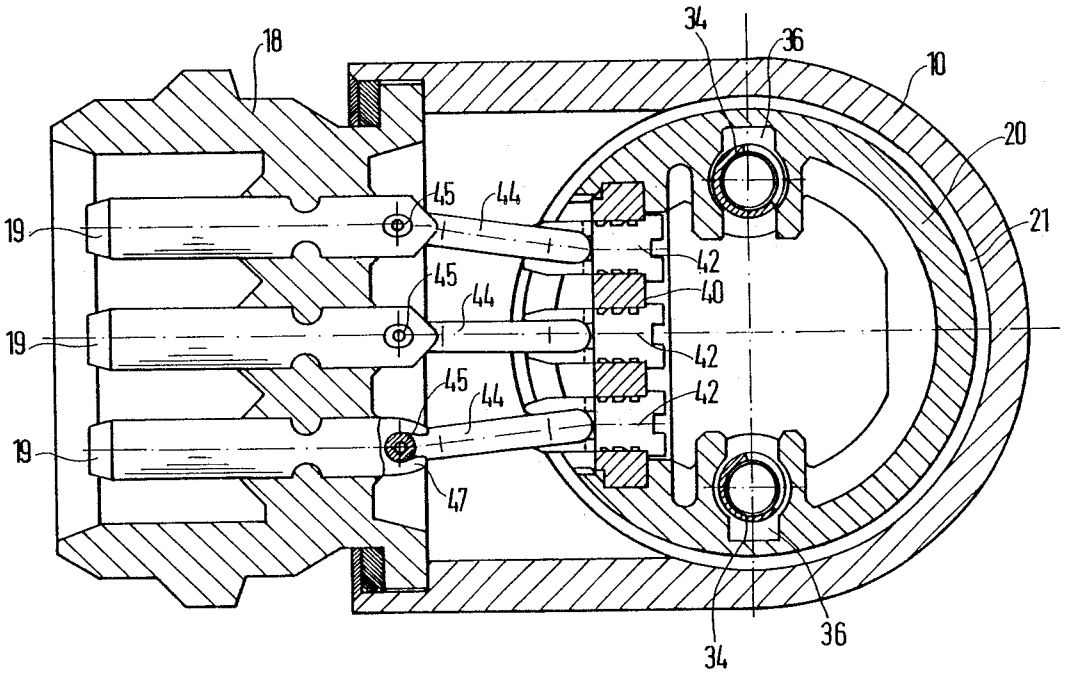
FIG. 4 is a cross sectional view along line E–H in FIG. 3.

The outer housing 10 further includes a radially projecting plug socket 18 with three flat plugs 19 held at mutual spacings in the socket, such as by injection if the housing and plug socket are injection molded plastic members, as illustrated most clearly in FIGS. 3 and 4.

Figure 2:
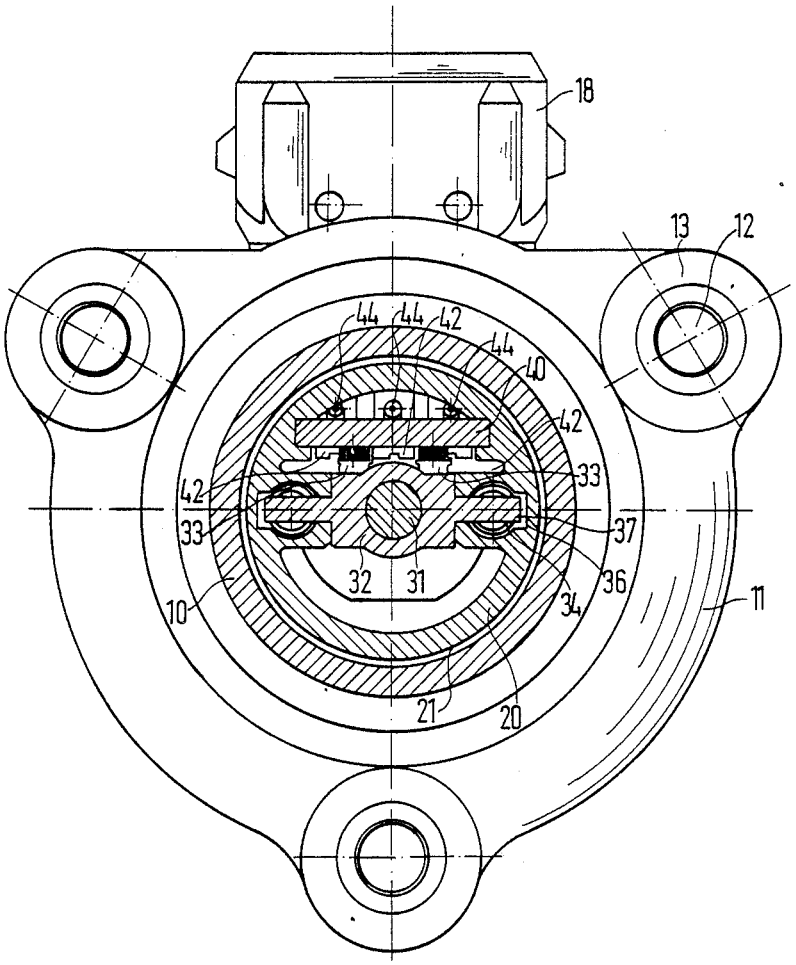
FIG. 2 is a cross sectional view along line C–D in FIG. 1.

As shown in FIG. 2, the interior wall of the outer housing is cylindrical except for the area which is adjoined by the plug socket 18. An inner housing 20 is placed inside the outer housing 10, extending coaxially with the outer housing 10 and having an outer diameter which is smaller than the inner diameter of the outer housing 10 where by an intermediate space 21 of circular ring shape is formed between both housings 10 and 20. This intermediate space allows certain relative displacement between the inner and outer housings in radial direction, i.e. perpendicularly with respect to the longitudinal axis of the potentiometer. As its one face end, hereinafter referred to as the actuating end, the inner housing 20 is joined integrally with a bearing flange 22, shown in FIG. 1, which is formed substantially cylindrically and has a journal bearing bushing 23 pressed or cast into it.

FIG. 1 also shows that the end opposed to the actuating end of the inner housing 20 is closed by a cap 24 which is insertable here. The surface of the cap 24, directed axially outwardly, is located at a spacing from the inwardly directed face of the bottom 15 of the housing so that the inner housing 20 can be displaced with respect to the outer housing 10 in axial direction too. Similarly, a corresponding axial spacing 26 is formed, at the actuating end, between the cap 14 of the outer housing and a web-type link 25 connecting the cylindrical portion of the inner housing to the bearing flange 22.

Damping members 27 and 27', respectively, being elastic like a spring are provided in the region of both face ends of the inner housing. In the embodiment shown, the springy damping member is an O-ring which holds the inner housing 20 in relation to the outer housing 10. Exact fixing in axial and radial directions alike is obtained by the inner housing 20 being formed at the web-type link 25 with a rectangular step 28 (FIG. 1) whereby the O-ring 27 will abut against a radially outwardly directed face as well as a face at right angles to the same and oriented in axial direction. Similarly, the cap 24 has a step 29 whose face directed axially is just flush with the end face of the inner housing 20. The corresponding O-ring 27' thus likewise lies in contact with two faces which extend at right angles and belong to the cap 24 and outer housing 10, respectively.

The O-ring 27 at the actuating end, moreover, engages the radially inwardly directed wall of the outer housing 10 and the face of cap 14 oriented in axial direction so that the outer housing 10, too (including the cap 14) has contact surfaces at right angles with respect to each other and in engagement with the O-ring 27. The same, finally, applies to O-ring 27' which rests against the radially inwardly directed face of the outer housing 10 as well as on the inwardly directed surface of the bottom 15 of the housing.

The two springy damping members 27 and 27', on the one hand, fix the inner housing 20 inside the outer housing 10 and, on the other hand, because of their spring elasticity, they permit certain relative displacement between the inner and outer housings. The properties of the material of which they are made cause strong damping of vibrations or impacts to which the outer housing is exposed so that the inner housing will be subjected only very little to such oscillations or shocks.

As the springy damping members 27 and 27' are disposed at the greatest possible spacing in axial direction of the inner housing 20, maximum clamping length is obtained and thus optimum vibration damping of the inner housing 20 is also obtained.

FIG. 2 shows that an actuator member 30 is supported in the inner housing. In the present embodiment, it consists of shaft 31 and a spring carrier 32. The shaft 31 is embodied by a cylindrical member, and it is guided in the journal bearing bushing 23. The spring carrier 32 is attached to one end of the shaft 31. It carries one or more slider springs 33 having their free ends in contact with predetermined paths on a resistor plug 40 so as to slide along the same when the spring carrier 32 is being displaced. In the actual embodiment the spring carrier 32 is biased in one direction by compression springs 34. These compression springs 34, on the one hand, are supported in the inner housing, specifically on a pin 35' formed on the cap 24 of the inner housing, and, on the other hand, at the spring carrier 32 where they are guided by pins 35. As seen best in FIG. 2, the spring carrier 32 also is guided in the inner housing 20 in a manner so as not to be rotatable. Thus, it is guided in grooves 36 which extend parallel to the axial direction and into which protrude lateral cantilever-type arms 37 of the spring carrier 32. The compression springs 34 likewise are guided in these grooves.

Also, the resistor plate 40 mentioned above is secured in the inner housing 20 and it carries resistor paths 41 along which may glide the slider spring 33 as shown in FIG. 3. The resistor paths are in contact with connecting lugs 42, likewise attached to the resistor plate 40 and embodied, in this instance, by contact springs as they are urged by spring pressure alone against the ends of the resistor paths.

As shown in FIG. 3, the connecting lugs 42 are passed through the resistor plate 40 and then are bent so that one portion thereof will extend parallel to the resistor plate. At the ends, again, they are substantially at right angles, away from the resistor plate and being formed into a clamp 43. The electrical connection needed between the connecting lug 42 and the associated flat plug 19 is established by a flexible stranded wire 44 laid in an S shape. The stranded wire 44 is fastened by soldering spots 45 and 46 at the connecting lug 42 and at the flat plug 19, respectively, so as to provide good electrical contact. In the transitional zone towards the soldering spots, stranded wires attached by soldering cannot be loaded very much and have a tendency to rupture easily, especially in case of mechanical vibrations. For this reason, the stranded wire 44 is also clamped mechanically at both its end regions. At one end this is accomplished by the clamp 43 at the connecting lug 42 and, at the other end, by another clamp 47 at the plug socket 18. The plug socket 18 is joined rigidly with the outer housing 10, as explained, whereas the resistor plate 40 and thus the connecting lug 42, are connected rigidly to the inner housing 20. Consequently, the stranded wire 44 lies between the two housings 10 and 20 which vibrate or move with respect to each other. Of course, the stranded wire must not transfer mechanical vibration coupling. This is excluded by its mechanical flexibility and the placing of it in an S shape. On the other hand, however, it must be connected firmly at both ends to the respective associated structural component to make sure that the potentiometer will not fail because of rupture of the stranded wire.

Briefly summarizing, the embodiment described above has the inner housing 20 and all the functional components inside the same, such as the resistor plate 40, slider carrier 32, and shaft 31 uncoupled from the outer housing 10 with respect to vibrations. In assembling the potentiometer and another object, i.e. mounting it on an engine block, attention must be paid so that the vibrations of the engine block are not introduced by way of the actuator member, specifically the shaft 31, and thus become coupled into the inner housing and the components inside the same. To accomplish that, the coupling or connecting between the shaft 31 and part of such other object likewise must be made in a manner to guarantee the uncoupling of vibrations. Magnetic coupling, for example, may be provided to this end as it will make sure that at least high frequency vibrations or movements with high acceleration or abrupt variations in the acceleration (jerks) will be transmitted to the shaft 31 after having been, dampened out. In the case of the embodiment shown, the shaft 31 is to sense the position of a structural member by its own axial position. If that structural member is a bar or rod, it is sufficient for obtaining a proper connection if the ends of the shaft 31 and the bar or rod touch each other, while they may be movable in radial direction (with reference to the axis of shaft 31). This alone will provide substantial uncoupling in radial direction. However, care must be taken to make sure that the bar or rod in question is supported in a manner to dampen vibrations.

Figure 5:
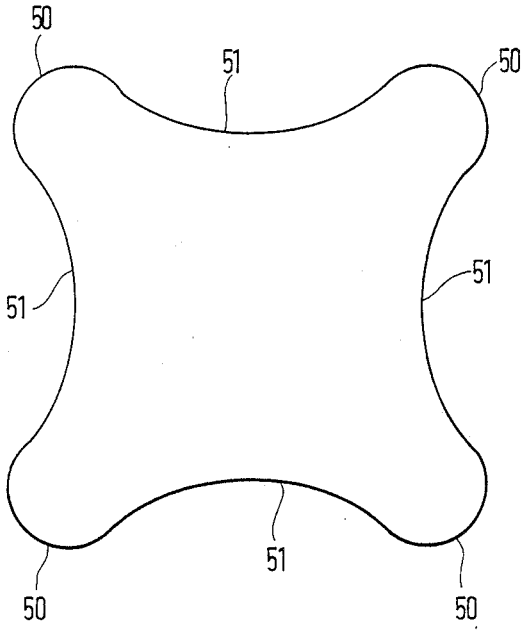
FIG. 5 is a cross sectional view of an outline of the springy damping members used with the invention.

The vibrational uncoupling between the inner and outer housing can be even more improved and still better damping achieved if the two O-rings 27 and 27' are replaced by rings of rubber or silicone having the cross sectional configuration illustrated in FIG. 5. This is the shape of a square having circularly rounded edges 50 and concavely (inwardly) deformed sidewalls 51. Such rings are commercial articles and are distributed, for example, by Messrs. BUSAK & LUYKEN under the registered trademark "Quad-Ring".

What is claimed is:

1. A potentiometer that can be attached to an object that can vibrate and used to produce an electrical signal responsive to a signal from said object comprising:

an outer housing;

an inner housing disposed substantially within said outer housing;

damping means disposed between said inner housing and said outer housing for damping vibrations;

a resistor plate having at least one resistor path attached to said inner housing;

actuating means for detecting said signal;

electrically conductive sliding means attached to said actuating means for contacting said at least one resistor path at a location that corresponds to said position;

an electrical output disposed on said outer housing for outputting said electrical signal;

a plurality of electrodes disposed within said inner housing that are electrically connected to said at least one resistor path and said sliding means; and means for establishing an electrical connection between said electrical output and said plurality of electrodes, said electrical connection means also being flexible enough to withstand vibrations between said inner housing and said outer housing.

2. The potentiometer of claim 1 wherein said damping means includes two damping members, each damping member disposed between a two-faced edge of said inner housing and an opposed edge of said outer housing.

3. The potentiometer of claim 2 wherein said two-faced edge of said inner housing is formed with a step to receive and guide said damping member.

4. The potentiometer of claim 3 wherein said electrical connection means include a stranded wire both soldered and mechanically fixed at one end to each of said electrodes and at another end to said electrical output.

5. The potentiometer of claim 4 wherein each damping member is an O-ring.

6. The potentiometer of claim 4 wherein each damping member is a ring having a cross sectional configuration of a square with rounded corners and concavely deformed sides.

7. The potentiometer of claim 6 wherein each damping member is made of rubber, silicone or another spring-elastic plastic material.

8. The potentiometer of claim 1 wherein said actuating means includes a shaft that is linked in vibration-damped condition to an article that gives said signal.

9. The potentiometer of claim 8 wherein said outer housing includes a flange for attaching said potentiometer to said object.

10. The potentiometer of claim 1 wherein a shaft is linked in vibration-damped condition to a throttle valve and said potentiometer is attached to a motor block of an internal combustion engine by a flange attached to said outer housing.

11. A potentiometer that can be attached to an object that can vibrate and used to produce an electrical signal responsive to a signal from said object comprising:

an outer housing;

an inner housing disposed substantially within said outer housing, said inner housing containing a two-faced edge formed with a step;

damping means disposed between said inner housing and said outer housing for damping vibrations, said damping means including two damping members, each damping member disposed in said step between said two faced edge of said inner housing and an opposite edge of said outer housing;

a resistor plate having at least one resistor path attached to said inner housing;

actuating means for detecting said signal;

electrically conductive sliding means attached to said actuating means for contacting said at least one resistor path at a location that corresponds to said position;

an electrical output disposed on said outer housing for outputting said electrical signal;

a plurality of electrodes disposed within said inner housing that are electrically connected to said at least one resistor path and said sliding means; and means for establishing an electrical connection between said electrical output and said plurality of electrodes, said electrical connection means also being flexible enough to withstand vibrations between said inner housing and said outer housing.

12. The potentiometer of claim 11 wherein said electrical connection means include a stranded wire both soldered and mechanically fixed at one end to each of said electrodes and at another end to said electrical output.

13. The potentiometer of claim 12 wherein each damping member is an O-ring.

14. The potentiometer of claim 12 wherein each damping member is a ring having a cross sectional configuration of a square with rounded corners and concavely deformed sides.

15. The potentiometer of claim 14 wherein each damping member is made of rubber, silicone or another spring-elastic plastic material.

16. The potentiometer of claim 11 wherein said actuating means includes a shaft that is linked in vibration-damped condition to an article that gives said signal.

17. The potentiometer of claim 16 wherein said outer housing includes a flange for attaching said potentiometer to said object.

18. The potentiometer of claim 11 wherein a shaft is linked in vibration-damped condition to a throttle valve and said potentiometer is attached to a motor block of an internal combustion engine by a flange attached to said outer housing.

19. A potentiometer that can be attached to an object that can vibrate and used to produce an electrical signal responsive to a signal from said object comprising:

an outer housing;

an inner housing disposed substantially within and moveable independently from said outer housing;

damping means disposed between said inner housing and said outer housing for damping vibrations between said inner housing and said outer housing;

a resistor plate having at least one resistor path attached to said inner housing;

actuating means for detecting said signal;

electrically conductive sliding means attached to said actuating means for contacting said at least one resistor path at a location that corresponds to said position;

an electrical output disposed on said outer housing for outputting said electrical signal;

a plurality of electrodes disposed within said inner housing that are electrically connected to said at least one resistor path and said sliding means; and means for establishing an electrical connection between said electrical output and said plurality of electrodes, said electrical connection means also being flexible enough to withstand vibrations between said inner housing and said outer housing.

* * * * *